United States Patent [19]

Kawabata et al.

[11] 4,450,678

[45] May 29, 1984

[54] AIR NOZZLE UTILIZED FOR FASCIATED YARN SPINNING

[75] Inventors: Susumu Kawabata, Aichi; Hiroshi Niimi, Nagoya; Meiji Anahara, Kariya; Yoshihisa Suzuki, Chiryu; Hiroshi Omori, Aichi, all of Japan

[73] Assignees: Kabushiki Kaisha Toyoda Jidoshokki Seisakusho; Kabushiki Kaisha Toyota Chuo Kenkyusho, both of Aichi, Japan

[21] Appl. No.: 451,754

[22] Filed: Dec. 21, 1982

[30] Foreign Application Priority Data

Dec. 29, 1981 [JP] Japan ..... 56-211388

[51] Int. Cl.[3] ..... D02G 1/16

[52] U.S. Cl. ..... 57/333; 57/908

[58] Field of Search ..... 57/332, 333, 350, 403, 57/908

[56] References Cited

U.S. PATENT DOCUMENTS 4,064,684 12/1977 Nijhuis ..... 57/333 X 4,141,121 2/1979 Trifunovic ..... 57/333 X

*Primary Examiner*—Donald Watkins

*Attorney, Agent, or Firm*—Burgess, Ryan & Wayne

[57] ABSTRACT

An air nozzle, suitable for producing a fasciated yarn, having at least one jet in each of narrow and wide passages along the traveling direction of the fiber bundle. Each jet is directed to generate a vortex whirling reversely from that of the other passage. The twist imparted to the fiber bundle by the vortex generated in the wide passage is restrained by the vortex whirling reversely thereto in the narrow passage. As a result, circumferential fibers of the fiber bundle are less twisted relative to the core portion thereof. During the untwisting operation of the vortex of the wide passage, the circumferential fibers are entangled around the core portion with a twist corresponding to the difference from the core portion, thereby obtaining a well-fasciated yarn.

7 Claims, 5 Drawing Figures

AIR NOZZLE UTILIZED FOR FASCIATED YARN SPINNING

BACKGROUND OF THE INVENTION

1. Field of the Art

This invention relates to an air nozzle utilized for fasciated yarn spinning. More specifically, this invention relates to an air nozzle for continuously false-twisting a fiber bundle delivered from a pair of front rollers of a fiber drafting arrangement, thereby entangling surface fibers of the fiber bundle around a core portion thereof to form a so-called fasciated yarn.

2. Description of the Prior Art

Many apparatus for obtaining a fasciated yarn have been proposed in the past. In Japanese Examined Patent Publication No. 56-31370 is disclosed an apparatus in which first and second air nozzles are arranged in series along a traveling direction of a fiber bundle, each of the air nozzles generating a vortex therein whirling in a direction reverse from each other. The twist imparted to the fiber bundle by the vortex in the second air nozzle ascends upstream along the fiber bundle and is untwisted by the reverse vortex in the first air nozzle. This apparatus is said to produce a well-fasciated yarn. The apparatus, however, has the following problems.

1. The overall installation becomes large and complicated due to the two separately disposed air nozzles.

2. It is difficult to properly adjust the distance and pressures of the two nozzles so that the air streams discharged from the nozzles do not interfere with each other and so that the functions of the nozzles can be fully exhibited.

3. The air consumption and manufacturing cost of the apparatus is higher than single-nozzle type apparatuses.

In Japanese Unexamined Patent Publication No. 56-43425, two air twisters, each of which functions to generate a vortex whirling reverse from each other are integrated in a single nozzle body. The structure of the air nozzle, however, is not disclosed at all, so it is not possible to determine how to obtain the desired directional vortex in the air nozzle.

SUMMARY OF THE INVENTION

It is an object of the present invention to eliminate the above-mentioned drawbacks accompanying the known apparatus. Namely, it is an object of the present invention to provide an air nozzle which can be compactly incorporated in a fasciated yarn spinning frame and is free from operational troubles caused by difficulties of positioning and condition setting of the air nozzle, and which also features reduced air consumption and manufacturing cost.

According to the present invention, there is provided an air nozzle utilized for fasciated yarn spinning comprising a narrow passage and a wide passage for a fiber bundle arranged in series along a traveling direction of the fiber bundle, characterized in that each of the two passages is provided with at least a jet for ejecting an air flow toward the traveling direction of the fiber bundle and in that each jet inclines to intersect an axis of each passage at an acute angle, the direction of each jet being tangential to each passage but reverse to that of another jet about the axis of the passage.

BRIEF DESCRIPTION OF THE DRAWINGS

The present invention will be explained more fully hereinafter with reference to the accompanying drawings, wherein.

DESCRIPTION OF THE PREFERRED EMBODIMENTS

Figure 1:
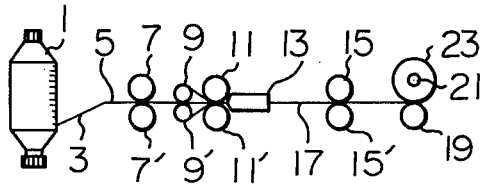
FIG. 1 illustrates a schematic frontal view of a fasciated yarn spinning frame incorporating an air nozzle according to the present invention.

In FIG. 1, a fiber bundle 3 unwound from a roving bobbin 1 is supplied through a guide 5 to a drafting arrangement and attenuated by pairs of back rollers 7.7′, aprons 9.9′, and front rollers 11, 11′. The fiber bundle 3 then reaches a pair of delivery rollers 15, 15′ through the air nozzle 13. When passing through the air nozzle 13, the fiber bundle 3 is imparted with a false-twist, whereby its core portion is entangled with its edge portion fibers to form a fasciated yarn 17. The fasciated yarn 17 is wound onto a bobbin 21 frictionally driven by a winding drum 19 to form a package 23.

The air nozzle 13 according to the present invention will be explained referring to FIG. 2. The rear portion of the air nozzle 13 confronting the front rollers 11, 11′ is of a curved surface complementary to the front surface of the front rollers 11, 11′, allowing the air nozzle 13 to be disposed as close as possible to the front rollers 11, 11′. In the air nozzle 13, an inlet 13*a* of a converged conical shape, a narrow passage 13*b*, and a wide passage 13*c* are arranged coaxially in series. The conical shaped inlet 13*a* facilitates the introduction of the fiber bundle 3, flattened and widened due to the nip of the front rollers 11, 11′, smoothly into the narrow passage 13*b*.

Figure 2:
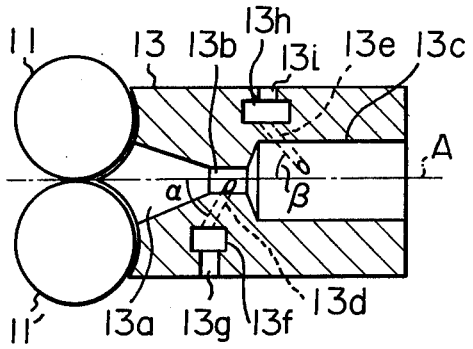
FIG. 2 illustrates a sectional front view of an embodiment according to the present invention.
Figure 3:
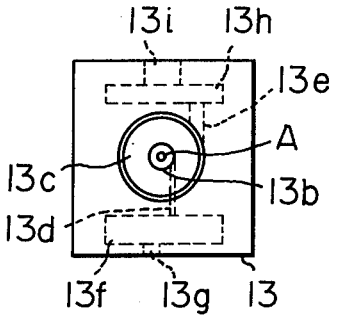
FIG. 3 illustrates a right-side view of the embodiment shown in FIG. 2.

The narrow and wide passages 13*b* and 13*c* are provided with tangential jets 13*d* and 13*e*, respectively, on their inner wall (see FIG. 3). As shown in FIG. 3, the jets 13*d* and 13*e* open so as to generate first and second vortices whirling reversely from each other about an axis A of the passages 13*a* and 13*b*. As shown in FIG. 2, the jets 13*d* and 13*e* incline relative to the axis A with acute angles $\alpha$ and $\beta$, respectively, from upstream to downstream, $\alpha$ and $\beta$ preferably being within a range from 30° to 70°. The jet 13*d* is connected to a compressed air source (not shown) through an air tank 13*f* and a duct 13*g* formed in the nozzle wall. Also, the jet 13*e* is connected to the compressed air source (not shown) through an air tank 13*h* and a duct 13*i* formed in the nozzle wall. The cross-sectional size of the jet 13*e* is preferably not less than that of the jet 13*d*, for example, of a ratio to that of the jet 13*d* of within a range from 2:1 to 20:1. "Cross-sectional size" in the case of a multi-jet nozzle described hereinafter, means the sum of all jets.

Accordingly, as compressed air is supplied to the jets 13*d* and 13*e*, vortices whirling reversely from each other are ejected within the passage 13*b* and 13*c*, respectively. The second vortex generated in the wide passage 13*c* has a stronger torque than the first vortex of the narrow passage 13*b* because the former is larger both in radius and air velocity relative to the latter. Therefore, the twisting operation for the whole fiber bundle is carried out substantially by the second vortex ejected from the jet 13*e*. On the other hand, the first vortex from the jet 13*d* opening in the narrow passage 13*b* facilitates the untwisting of the entangled circumferential fibers, thereby restraining the ascent of the twist along the fiber bundle caused by the torque of the second vortex within the wide passage 13*c* to the nip point of the front rollers 11 and 11', as well as the sucking of the fiber bundle 3 into the inlet 13*a* of the air nozzle 13.

As mentioned above, the wide passage 13*c* functions mainly to twist the fiber bundle, and the narrow passage 13*b* functions mainly to suck the fiber bundle into the inlet 13*a*. It is desirable to design the radius of the former in a range from 5:1 to 5:4 relative to that of the latter. Further, the distance between the jets 13*d* and 13*e* is preferably at least 4 mm, more preferably not less than 8 mm, but not exceeding a half of the mean fiber length comprising the fiber bundle processed. If the distance between two jets is less than 4 mm, the stretching effect and the untwisting effect of the first vortex caused by the jet 13*d* opening in the narrow passage 13*b* become insufficient and the twisting effect of the second vortex caused by the jet 13*e* is weakened. On the other hand, if the above distance is too long, the overall installation of the nozzle becomes excessively large and the cooperation of the jet 13*d* with the jet 13*e* cannot be fully performed.

The passages 13*b* or 13*c* may be of a cylindrical or a conical shape diverged downstream. The passages 13*b* and 13*c* are preferably formed in a conical shape to enhance the sucking effect of the inlet 13*a*.

As described above, the twisting effect of the jets 13*d* and 13*e* is influenced by many factors, such as the deviation of the jets 13*d* and 13*e* from the axis A of the passage, the quantity and pressure of the air ejected from the jets, and the inclination angles $\alpha$ and $\beta$ of the jets relative to the axis A. As to the angles $\alpha$ and $\beta$, each of them must be acute for sucking the fiber bundle smoothly downstream from the inlet 13*a*, thereby preventing the generation of flies behind the front rollers 11, 11' and also stretching the edge portion fibers of the fiber bundle to develop the fasciated effect. As the angle $\alpha$ becomes smaller, the sucking effect grows larger. As the angle $\beta$ is closer to a right angle, the twisting effect becomes maximum.

In the above-mentioned example, the air nozzle 13 is disposed just behind the front rollers 11 and 11'. However, the position of the air nozzle 13 is not necessarily confined to the above case. The air nozzle 13 may be disposed behind any rollers provided the rollers are the last ones of the drafting arrangement.

It is preferable that the inlet 13*a*, the narrow passage 13*b*, and the wide passage 13*c* be arranged coaxially. However, the alignment does not have to be so strict if the fiber bundle can be passed therethrough without any hindrance.

According to the embodiment shown in FIGS. 2 and 3, the fiber bundle supplied from the front rollers 11 and 11' is sucked by the first vortex ejected from the jet 13*d* opening in the narrow passage 13*b*, and the edge portion fibers of the fiber bundle are stretched along the traveling direction thereof. Thereafter, the fiber bundle is twisted by the second vortex ejected from the jet 13*e* opening in the wide passage 13*c*. The twist imparted to the fiber bundle ascends upstream, i.e., toward the front rollers. On the other hand, the circumferential fibers entangled around the core portion are untwisted by the first vortex ejected from the jet 13*d* because the rotational direction of the first vortex is reverse from that of the second. Accordingly, the twist distribution in the fiber bundle is denser in the core portion relative to the circumferential portion. In the midportion of the wide passage 13*c*, the fiber bundle is untwisted as a whole. Finally, the twist of the core portion becomes zero and the circumferential fibers reversely entangle and bind the core portion with a twist remainder therebetween. This entanglement of the circumferential fibers results in good mechanical strength and appearance of the resultant fasciated yarn.

Figure 4:
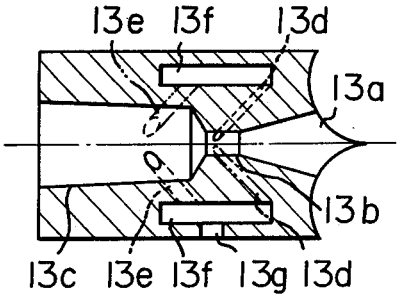
FIG. 4 illustrates a sectional front view of another embodiment according to the present invention.
Figure 5:
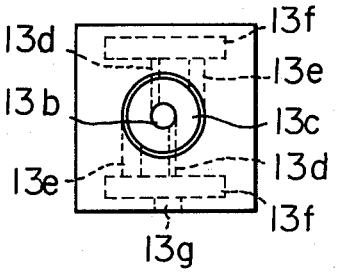
FIG. 5 illustrates a left-side view of the the embodiment shown in FIG. 4.

A second embodiment of the present invention is illustrated in FIGS. 4 and 5, in which two jets 13*d* and two jets 13*e* are equidistantly provided around passages 13*b* and 13*c*, respectively. According to the second embodiment, the fiber bundle can travel through the passages without deviation from the axis. The number of the jets 13*d* or 13*e*, of course, is voluntary.

One of each of jets 13*d*, 13*d* and 13*e*, 13*e* in FIG. 4 is depicted by a chain line (rather than broken line) for expediency, though it cannot actually be seen in the drawing.

It is preferable to provide a common air tank for distributing the compressed air to the jets in accordance with the sizes of the jets and the air pressure thereby reducing the number of instruments for air supply, such as compressed air sources, ducts, and pressure regulators and simplifying the structure of the air nozzle.

According to the present invention, a yarn having both good strength and appearance with less fluffs can be obtained. Further, since two nozzle functions are integrated together in one body, the total installation can be compactly arranged. Moreover, total air consumption and maintenance labour considerably decrease compared to the conventional apparatus of two nozzle type.

We claim:

1. An air nozzle utilized for fasciated yarn spinning comprising a narrow passage and a wide passage for a fiber bundle arranged in series along a traveling direction of said fiber bundle, characterized in that each of said two passages is provided with at least a jet for ejecting an air flow toward the traveling direction of said fiber bundle and in that said each jet inclines to intersect an axis of each said passage at an acute angle, the direction of each said jet being tangential to said each passage but reverse to that of another jet about said axis of said passage.

2. An air nozzle according to claim 1, further comprising a conical shaped inlet conducted to said narrow passage.

3. An air nozzle according to claim 1 in which said each jet communicates to a common air tank provided in said air nozzle.

4. An air nozzle according to claim 2, in which said each jet communicates to a common air tank provided in said air nozzle.

5. An air nozzle according to claim 1, in which at least one of said narrow passage and said wide passage is of a conical shape diverged downstream.

6. An air nozzle according to claim 2, in which at least one of said narrow passage and said wide passage is of a conical shape diverged downstream.

7. An air nozzle according to claim 3, in which at least one of said narrow passage and said wide passage is of a conical shape diverged downstream.

* * * * *